US006285332B1

(12) United States Patent
Chandler

(10) Patent No.: US 6,285,332 B1
(45) Date of Patent: Sep. 4, 2001

(54) FREQUENCY SELECTIVE REFLECTOR

(75) Inventor: Charles W. Chandler, San Gabriel, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/393,116

(22) Filed: Sep. 10, 1999

(51) Int. Cl.[7] ..... H01Q 19/00
(52) U.S. Cl. ..... 343/756; 343/909
(58) Field of Search ..... 343/756, 753, 343/909, 910, 912, 914, 755

(56) References Cited

U.S. PATENT DOCUMENTS

| | | | | |
|---|---|---|---|---|
| 4,544,928 | * | 10/1985 | Afifi et al. | 343/781 |
| 5,283,591 | * | 2/1994 | Delmas | 343/755 |
| 5,606,335 | * | 2/1997 | English et al. | 343/909 |
| 5,861,860 | * | 1/1999 | Stanek et al. | 343/909 |

* cited by examiner

*Primary Examiner*—Don Wong
*Assistant Examiner*—Ephrem Alemu
(74) *Attorney, Agent, or Firm*—Robert W. Keller

(57) ABSTRACT

A frequency selective reflector is provided for use in an electromagnetic antenna system, wherein the frequency selective reflector reflects electromagnetic waves having two or more frequencies. The reflector includes an inner portion which has a reflective surface which will reflect at least first and second frequencies. The reflector also includes an outer portion which will reflect electromagnetic waves having the first frequency in substantially the same direction as electromagnetic waves of the first frequency reflected from the inner portion. On the other hand, the outer portion is constructed to prevent the constructive reflection of electromagnetic waves of the second frequency in the same direction as electromagnetic waves of the second frequency reflected from the inner portion. By setting the diameter between the inner and outer circuit portions to have a predetermined relationship to one another, the reflector's electrical size in terms of wavelength can be substantially equalized for the first and second frequencies so that the beam width of the radiation patterns for the first and second frequencies will be superimposed and substantially equal to one another.

33 Claims, 2 Drawing Sheets

FREQUENCY SELECTIVE REFLECTOR

BACKGROUND OF THE INVENTION

The present invention is directed to reflectors for use in electromagnetic antenna systems, and, more particularly, to reflectors capable of reflecting electromagnetic signals having two or more frequencies.

In the communication field, a number of systems exist which require antenna systems to be capable of operating at two or more frequencies. For example, in military and commercial satellites systems, it is common for the uplink signal from a ground station to the satellite to have a first frequency while the downlink signal from the satellite to the ground station has a second frequency. Commercial and military Ka-Band communication satellites are one example of this where the uplink frequency is 20 GHz and the downlink frequency is 30 GHz.

In the past, communication satellites systems such as those mentioned above have handled the two frequencies by using reflector antenna systems in the satellites which are designed with an antenna feed (for example, a feed horn) and a reflector system (generally using a concave primary reflector and a sub-reflector). One technique in such systems has been to provide two antenna feeds with each one designed to shape the beam so that the uplink receiving beam of the satellite (for example, at 30 GHz) will have substantially the same beam width as the downlink transmitted beam from the satellite (e.g., at 20 GHz). Designing the feeds for this purpose is difficult, and they are sometimes not realizable within the practical constraints of the satellite environment. An alternative approach is to use a separate reflector for each frequency. This, of course, is not advantageous in a satellite system, given the limitations of size and weight which must be considered.

SUMMARY OF THE INVENTION

Accordingly, an object of the present invention is to provide an improved reflector for an electromagnetic antenna system which is capable of reflecting two or more frequencies having substantial equal beam widths.

It is a further object of the present invention to provide such an improved reflector system without requiring specialized feed design and without requiring separate reflectors for each of the frequencies.

It is a further object of the present invention to provide an improved reflector for use in a satellite communication system which permits a single reflector to receive the uplink signal at one frequency and to transmit the downlink signal at a second frequency, wherein the beam widths of the receiving pattern for the uplink signal and the transmitting pattern for the downlink signal are substantially the same, and wherein these patterns overlap one another.

To achieve these and other objects in accordance with one aspect of the present invention, a frequency selective reflector is provided for receiving and reflecting electromagnetic waves, including an inner reflector portion and an outer reflector portion. The inner portion has a reflector surface which reflects electromagnetic waves having first and second frequencies. The outer portion reflector has a surface which will constructively reflect electromagnetic waves having the first frequency but will non-constructively reflect electromagnetic waves having the second frequency.

In accordance with another aspect of the present invention, a frequency selective reflector is provided having an inner portion which reflects electromagnetic waves having first and second frequencies, and an outer diffraction portion which diffracts electromagnetic waves having the first frequency in a direction to align them with the electromagnetic waves of the first frequency reflected from the inner portion, and which diverts electromagnetic waves of the second frequency in a direction different from the direction of the electromagnetic waves of the second frequency reflected from the inner portion.

DETAILED DESCRIPTION

Figure 1:
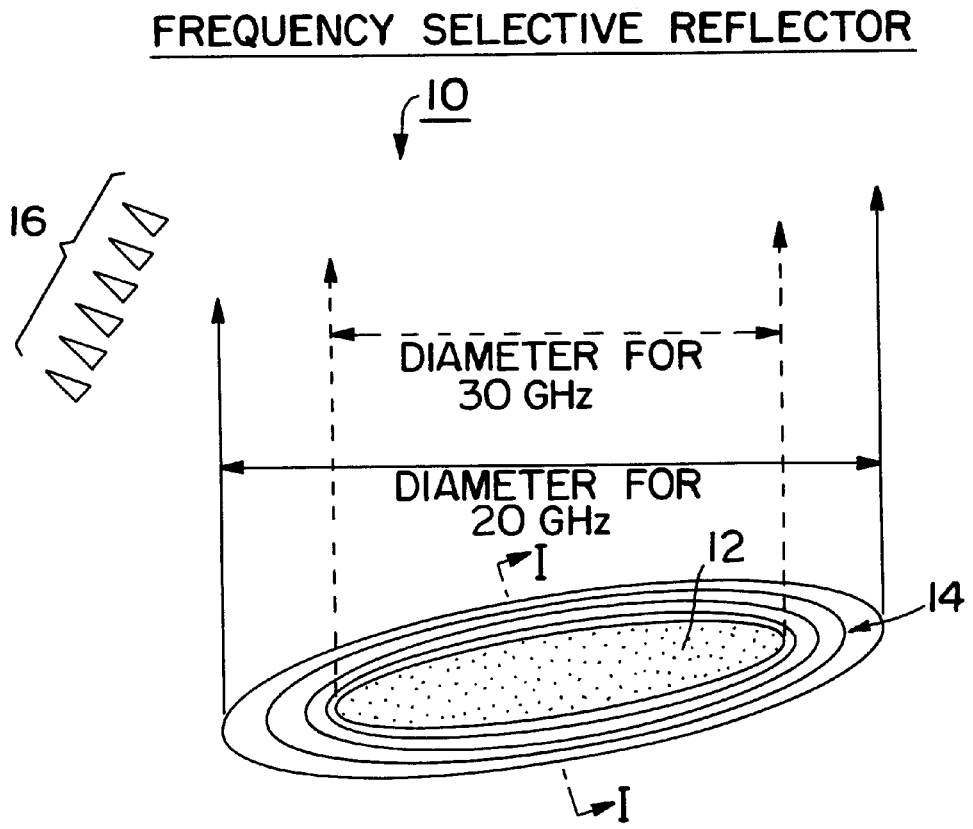
FIG. 1 shows an overall view of a preferred embodiment of the present invention.

Turning to FIG. 1, a preferred embodiment of the present invention is shown for a frequency selective reflector 10. The frequency selective reflector 10 includes an inner reflector portion 12, which is preferably a solid surface, and an outer reflector portion 14 surrounding the inner reflector. The outer reflector portion is designed to reflect one or more frequencies in the same direction in which they are reflected by the inner reflector 12, while, at the same time, not constructively reflecting one or more of the other frequencies in the same direction in which they are reflected by the inner reflector 12. This will be discussed in greater detail below.

A plurality of feeds 16 (for example, horn feeds, although other feeds could also be used) are located to each produce a beam at a single frequency to either radiate a beam onto the frequency selective reflector 10 (in the transmission mode) or to receive a beam from the reflector 10 (in the receive mode). The illustration of these feeds 16 relative to the reflector 10 is a simplified illustration since the details of the particular feeds used do not form a part of the present invention. It is noted, however, that the reflector of the present invention can be used in a variety of reflector structures, including two reflector systems such as offset, Cassegrain, front-fed, side-fed and Gregorian, by way of example. If the reflector of the present invention is used as the primary reflector in a two reflector system, it will generally be concave, although the invention is not limited to this.

The present invention can be used in a variety of multiple frequency systems using two or more frequencies. For purposes of illustration only, the following description will be directed to a preferred embodiment of a dual frequency Ka-Band communication satellite system (commonly used for both commercial and military systems), using 30 GHz for the uplink signals and 20 GHz for the downlink signals. Further, although the present invention can be used both for ground stations and satellite antennas (as well as in systems other than satellite communication systems), the following description is directed to a satellite antenna used in such a Ka-Band communication satellite system wherein the same reflector can be used for both receiving the 30 GHz uplink signal and the transmitted 20 GHz downlink signal in conjunction with the feeds 16. With regard to this, it is noted that a plurality of such feeds 16 can be located relative to the reflector 10 to provide beam coverage at different locations on the earth's surface. In other words, multiple beams can be generated to communicate, for example, with different cities individually. In accordance with a preferred embodiment of the present invention described below, the half power beam width can be set for a circular beam at approximately 9°, although this is noted solely for purposes of example.

Turning to the Ka-Band embodiment, the present invention is particularly directed to providing equalized beam width patterns for both the 30 GHz uplink signal and the 20 GHz downlink signal. In order achieve this, the inner reflector portion 12 reflects both the 20 and 30 GHz signals, while the outer reflector portion 14 reflects only the 20 GHz signal in the direction of the main beam. As a result, the electrical aperture for the 30 GHz reflector surface is the diameter of the inner reflector 12, while the electrical aperture for the 20 GHz reflective surface is the total diameter of the frequency selective reflector 10 (including the inner reflector 12 and the outer reflector 14). Since beam width is inversely proportional to diameter, the inner reflector surface 12 should be two thirds of the diameter of the total reflector 10. For example, if the diameter of the total reflector 10 is set to be 75 λ (where λ equals 0.6 inches for the 20 GHz signal), this will be 60 inches. The inner reflector surface 12 will then be set to be 40 inches to achieve equal beam widths. It is noted that 40 inches is also 75 λ for the 30 GHz signal, given that λ equals 0.4 inches for this signal. These dimensions are, of course, solely for purposes of example since the invention can be practiced with different dimensions, both in terms of physical size and electrical size.

In conjunction with providing equal beam widths for the 20 GHz and the 30 GHz signals, the feeds 16 can be arranged to superimpose the 20 GHz beam pattern on the 30 GHz beam pattern to both transmit and receive signals to and from the satellite to the same predetermined area on the earth's surface. With the reflector dimensions noted above, and with appropriate generation of the feed patterns, overlapping circular beam having a half power beam width of 9° can be achieved for the transmitting and receiving beam patterns. Of course, modifications of these dimensions and the feed location could achieve other beam widths if desired.

Figure 2:
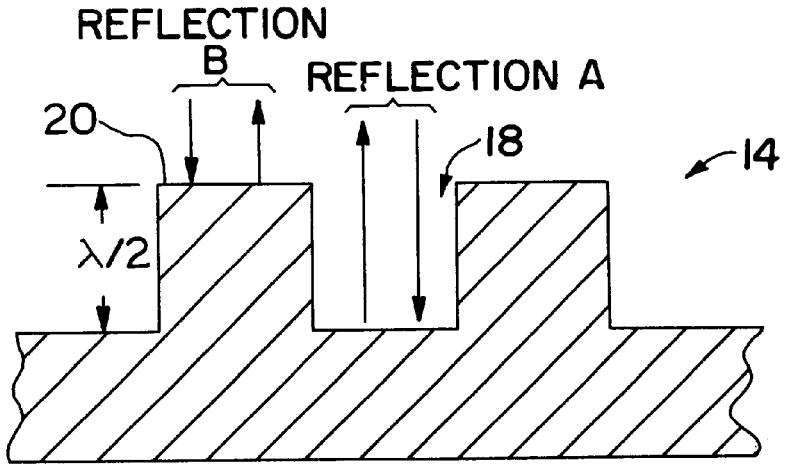
FIG. 2 shows a cross-sectional view taken in the direction I—I of FIG. 1 of a portion of a corrugated surface which can be used for the outer reflective portion in one embodiment of the present invention, wherein corrugation recesses are formed in the reflector surface.
Figure 3:
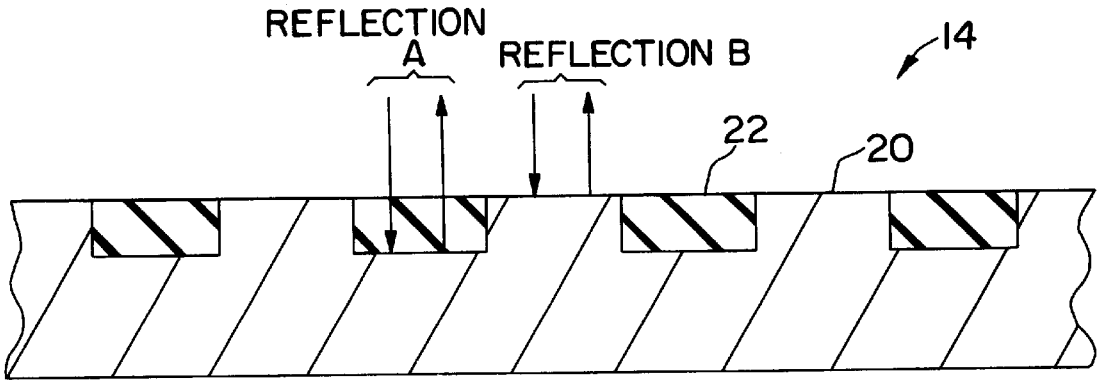
FIG. 3 shows an alternative of FIG. 2 for providing a corrugated surface.

FIGS. 2 and 3 show two different arrangements for providing corrugations for the outer reflector 14 so that the reflector will have the capability of cancelling a signal having one frequency while, at the same time, being able to reflect a signal having another frequency. These corrugations are formed as concentric circles arranged between the inner and outer diameter of the outer reflector 14, as shown in simplified fashion in FIG. 1.

The arrangement of FIG. 2 is actually primarily suitable for instances where the desired frequency and the undesired frequency are multiples of each other, for example, 20 GHz and 40 GHz, rather than for frequencies such as 20 GHz and 30 GHz discussed up to this point. However, the arrangement of FIG. 2 is discussed first for simplicity since it represents the situation where electrical depth (in terms of phase shift and λ) equates to physical depth (in terms of λ). This is generally not the case in the embodiments of FIGS. 3 and 4, as will be discussed later. Basically, in all three of these embodiments, the corrugations are provided to cause a 180° phase difference between reflection A and reflection B for the frequency to be cancelled, and a 90° phase difference between reflection A and reflection B for the frequency to be reinforced.

In FIG. 2, corrugations are provided in the reflector surface as corrugated recesses 18 that are approximately λ/2 deep both in terms of electrical and physical depth. By providing the corrugation recesses 18 with this depth, reflection A from the corrugation recess 18 for one signal (for example, 40 GHz) will be 180° out of phase relative to the reflection B of the same frequency signal from the upper surface 20 of the outer reflector 14. This 180° phase difference caused by the corrugation recesses 18 serves to effectively cancel the reflections from the upper surface 20 for signals at this frequency. In order to provide complete cancellation, the total area occupied by the corrugated recesses 18 can be set to be substantially equal to the total area occupied by the upper surface 20 of the outer reflector 14.

At the same time, the corrugation recesses 18 will reflect at λ/4 for signals of another frequency (for example, 20 GHz), thereby contributing to the reflection of such signals from the upper surface 20. As a result, the outer reflector 14 using this corrugation arrangement can effectively cancel a 40 GHz signal while reflecting a 20 GHz signal, as discussed above. In this case, the inner reflector 12 would be set to reflect both 20 GHz and 40 GHz.

FIG. 3 shows an alternative to forming the corrugation recesses 18 to be able to use the invention in situations where the frequencies in question are not multiples of one another. Specifically, in FIG. 3 the slots are at least partially filled with a material, such as the dielectric 22, which will cause a delay between the received wave and the reflected wave. In other words, in this case the desired 180° phase shift between the reflection A from the recess 18 and the reflection B from the adjacent upper surface 20 for the frequency to be cancelled (e.g., the 30 GHz signal in the present example) can be achieved by a combination of setting the depth of the corrugation recesses 18 and the characteristics of the dielectric material 22 filling the recesses. Of course, as in the case of FIG. 2, the dielectric material should be selected to be frequency sensitive so that the combination of the recess depth and the dielectric material will delay the desired wave (e.g., the 20 GHz signal in the present example) by an amount which will not cancel that wave, but, instead, combine with the wave reflected from the upper surface 20 so that, as a whole, the outer corrugated reflector 14 will reflect the desired wave. Preferably, this will be a 90° phase difference between reflection A and reflection B for the frequency to be reflected. It is to be noted that although this example specifically describes the use of dielectric, other suitable materials which will delay the reflected wave could also be used. An advantage of the embodiment shown in FIG. 3 is that the device can be used for frequencies that are not multiples, and the overall structure can be stronger since the recesses do not have to be as deep, and since the dielectric material provides structural strength to the reflector (noting that the reflector is preferably as thin and light weight as possible). In other words, in the embodiment of FIG. 3, the electrical depth of the recess 18 is λ/2 by virtue of the combined delay of the physical depth and the dielectric delay, but the actual physical depth can be less than λ/2.

Figure 4:
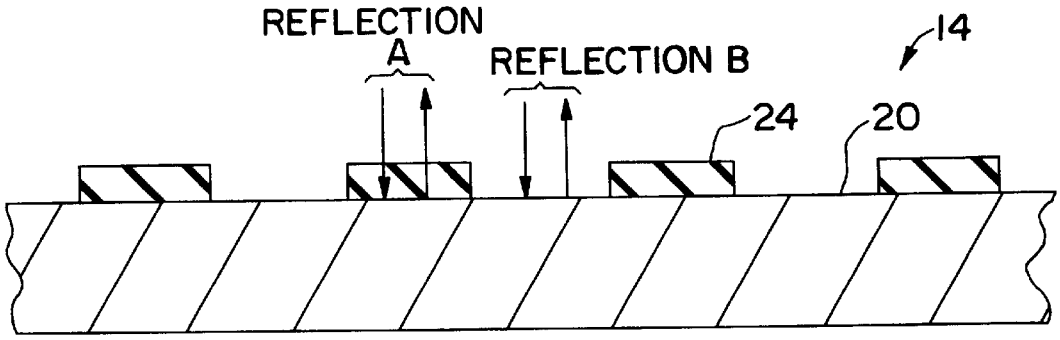
FIG. 4 shows a cross-sectional view taken in the direction I—I of FIG. 1 of a portion of a corrugated surface formed by stripes formed on the reflector surface of the outer reflector portion of another embodiment of the present invention.

FIG. 4 represents another embodiment which can be used for the surface of the outer reflector portion 14. In this case, corrugations are effectively formed by stripes 24 formed on the surface 20 of the reflector, rather than forming recesses in the surface of the reflector. In this case, the stripes 24 are constructed to cause a 180° phase difference between reflection A and reflection B for the frequency to be cancelled, while, at the same time, causing a phase difference such as 90° between reflection A and reflection B for the frequency to be reflected. Again, these stripes 24 could be made of dielectric material which will have an appropriate dielectric characteristic to obtain the desired phase shifts, although the present invention is not limited to only dielectric materials. Like FIG. 3, the embodiment of FIG. 4 can be used for frequencies that are not multiples of one another, including the 20 GHz and 30 GHz frequencies discussed herein.

In the above embodiments, an outer corrugated reflector 14 is used to effectively cancel one of the frequencies (for example, 30 GHz) while reflecting another frequency (e.g., 20 GHz). As such, these structures can be referred to as "cancelling edge treatment." FIG. 5, on the other hand, shows an embodiment which operates on a somewhat different principle. Specifically, FIG. 5 uses diffraction grating edge treatment for the outer reflector portion 14 to achieve the same goal of reflecting one or more frequencies in a desired direction while preventing one or more frequencies from being reflected in that same direction.

Figure 5:
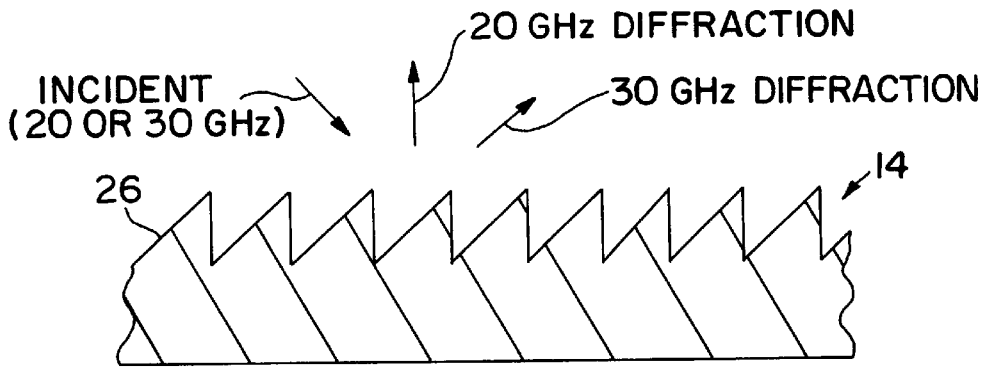
FIG. 5 shows a cross-sectional view taken in the direction I—I of FIG. 1 of an alternative embodiment of the present invention which uses a diffraction grating rather than corrugations for the outer reflector portion to deflect certain frequencies in different directions from the main beam pattern.

In FIG. 5, in place of the outer corrugated reflector 14 of FIGS. 2 to 4, the embodiment of FIG. 5 uses an outer diffraction grating surface 26. Using the same Ka-Band example discussed above, the inner reflector 12 will reflect both the 20 and 30 GHz signals. On the other hand, the outer diffraction grating 32 will diffract the 20 GHz signal in substantially the same direction as the inner reflector 12 reflects the 20 GHz signal, but will diffract the 30 GHz signal in a direction different from the direction that the inner reflector 12 reflects the 30 GHz signal. In other words, the outer reflector 14 will diffract the 20 GHz signal to align with the 20 GHz reflection from the inner reflector 12, but will divert the 30 GHz signal in a different direction. However, like the case of FIG. 1, the end result will be that the frequency selective reflector 10 will have an electrical aperture for the 30 GHz signal defined by the diameter of the inner solid reflector 12, while having an electrical aperture for the 20 GHz frequency signal defined by the total diameter of the frequency selector 10 (including the inner reflector 12 and the diffraction grating surface defining the outer reflector 14).

The same 2/3 ratio between the inner reflector diameter and the total diameter can be used in the FIG. 5 embodiment for the particular frequencies of 20 GHz and 30 GHz to achieve equal beam widths for the two difference frequencies. Thus, the same diameters of 40 inches for the inner reflector 12 and 60 inches for the total reflector 30 can be used.

It is noted that the various embodiments shown herein utilize circular reflectors since, in the preferred embodiment of the invention, it is intended to generate circular beams. However, it should be noted that the present invention can be used for non-circular reflectors, if desired, to generate non-circular beams. Such beams are often useful in covering specific geographic areas.

One advantage of the present invention is that it provides an arrangement for beam shaping using the reflector rather than requiring specially designed horns. In other words, the present invention permits less restrictive limitations on the horn design required, for example, for equalizing the E and H planes of the antenna patterns since such equalization can be achieved through the reflector design and the relative position between the reflector and the horn. For example, the E and H planes of a pattern from the reflector can be equalized by tapering off the pattern from the horn to a zero amplitude at the edge of the frequency selective reflector 10. This is based on the fact that peaks and nulls will exist across the surface of the reflector 10 from the pattern of the feeds 16. By setting the relationship between the feed 16 and the reflector 10 to provide a null at the outer edge of the reflector 10, equalized E and H plane patterns can be obtained for the reflector.

One example of a feed that could be used in conjunction with the present invention is disclosed in U.S. pat. application No. 09/270,960 filed on Mar. 16, 1999 by Charles Chandler and Makkalon M. Em entitled "Dual Depth Aperture Chokes for Dual Frequency Horns Equalizing E and H-Plane Patterns," which is hereby incorporated by reference. In that case, a feed horn is provided which is specifically designed to equalize E and H plane patterns. However, the present invention can be used in conjunction with such a horn (or a plurality of such horns) to provide further beam shaping at two or more frequencies.

Also, the above description sets forth an example of using the present invention with two frequencies in the Ka-Band. In general, the present invention is intended to provide antenna patterns within relatively narrow frequency ranges with a small bandwidth. However, if desired, the present invention can also be used in conjunction with systems having wider bandwidths. Of course, it is also noted that although the above description is directed to a dual frequency system, a greater number than two frequencies can be utilized. For example, the inner portion can reflect three or more frequencies, while the outer reflector (or diffraction grating) can be set to only reflect a predetermined number of these frequencies while cancelling or diffracting others in a different direction. If desired, corrugation recesses of different depths and/or dielectric recess fillers or stripes of different thicknesses can be provided to achieve the cancellation of two or more frequencies by the outer reflector. Of course, multiple outer corrugation bands or diffraction gratings can be provided to handle three or more frequencies, if desired. Also, the frequencies are not limited to the Ka-Band, but could be used with a variety of frequency bands.

Metal and graphite are preferred materials which can be used for the reflectors in the present invention since these materials are generally desirable for construction of satellite reflectors. Of course, other suitable materials could be used if desired.

Dielectric material used for filling the recesses or forming the corrugation stripes will depend on the particular frequencies involved, and can be frequency dependent. Thermoplastic foam can be used for such dielectric material having, for example, $\epsilon_r$ equals to 2.0.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

What is claimed is:

1. A frequency selective reflector for receiving and reflecting electromagnetic waves, comprising:

an inner portion having a reflective surface which reflects electromagnetic waves having a first frequency and electromagnetic waves having a second frequency; and an outer portion having a reflective surface which will constructively reflect electromagnetic waves having the first frequency but which will non-constructively reflect electromagnetic waves having the second frequency.

2. A frequency selective reflector according to claim 1, wherein the outer portion reflective surface includes elements which cancel electromagnetic waves having the second frequency.

3. A frequency selective reflector according to claim 1, wherein said outer portion substantially surrounds said inner portion.

4. A frequency selective reflector according to claim 3, wherein said reflector is substantially circular.

5. A frequency selective reflector according to claim 1, wherein said first frequency is less than said second frequency.

6. A frequency selective reflector according to claim 5, wherein said first frequency is 20 GHz and said second frequency is 30 GHz.

7. A frequency selective reflector for receiving and reflecting electromagnetic waves, comprising:

an inner portion having a reflective surface which reflects electromagnetic waves having a first frequency and electromagnetic waves having a second frequency; and an outer portion having a reflective surface which will constructively reflect electromagnetic waves having the first frequency but which will non-constructively reflect electromagnetic waves having the second frequency, wherein the outer portion reflective surface includes elements which cancel electromagnetic waves having the second frequency, wherein said elements comprise corrugation recesses having dimensions to reflect electromagnetic waves having the second frequency substantially 180° out of phase with respect to reflections of the electromagnetic waves having the second frequency from adjacent surfaces of the outer portion to thereby cancel the reflection of electromagnetic waves having the second frequency from the outer portion.

8. A frequency selective reflector according to claim 7, wherein said corrugation recesses are at least partially filled with a dielectric material.

9. A frequency selective reflector according to claim 8, wherein said reflector is substantially circular.

10. A frequency selective reflector for receiving and reflecting electromagnetic waves, comprising:

an inner portion having a reflective surface which reflects electromagnetic waves having a first frequency and electromagnetic waves having a second frequency; and an outer portion having a reflective surface which will constructively reflect electromagnetic waves having the first frequency but which will non-constructively reflect electromagnetic waves having the second frequency, wherein the outer portion reflective surface includes elements which cancel electromagnetic waves having the second frequency, wherein said elements comprise stripes formed of a material which will reflect electromagnetic waves having the second frequency substantially 180° out of phase with the reflection of electromagnetic waves having the second frequency from adjacent surfaces of the outer portion to thereby cancel the reflection of electromagnetic waves having the second frequency from the outer portion.

11. A frequency selective reflector according to claim 10, wherein said stripes are comprised of a dielectric material.

12. A frequency selective reflector for receiving and reflecting electromagnetic waves comprising:

an inner portion having a reflective surface which reflects electromagnetic waves having first and second frequencies; and an outer portion having a reflective surface which reflects electromagnetic waves having a first frequency in a direction to align with electromagnetic waves of the first frequency reflected from the inner portion and which diverts electromagnetic waves of the second frequency in a direction different from the direction of the reflection of electromagnetic waves of the second frequency reflected from the inner portion.

13. A frequency selective reflector according to claim 12, wherein the outer portion is comprised of a diffraction grating.

14. A frequency selective reflector according to claim 12, wherein said reflector is substantially circular.

15. A frequency selective reflector according to claim 12, wherein said outer portion substantially surrounds said inner portion.

16. A frequency selective reflector according to claim 15, wherein said reflector is substantially circular.

17. A frequency selective reflector according to claim 12, wherein said first frequency is less than said second frequency.

18. A frequency selective reflector according to claim 17, wherein said first frequency is 20 GHz and said frequency is 30 GHz.

19. A frequency selective reflector for an electromagnetic antenna comprising:

an inner portion having a reflective surface to reflect electromagnetic waves having first and second frequencies; and an outer portion having a reflective surface which will reflect electromagnetic waves having the first frequency in the same direction as the reflection direction of electromagnetic waves having the first frequency reflected from the inner portion, and which reflective surface prevents reflection of electromagnetic waves having the second frequency in the same direction as the direction of reflection of electromagnetic waves having the second frequency reflected from the inner surface, wherein the diameters of the inner and outer portions are selected so that the reflectors electrical size in terms of wavelengths will be substantially equalized for the first and second frequencies so that the beam widths of radiation patterns for the first and second frequencies will be substantially equalized.

20. A frequency selective reflector according to claim 19, wherein said reflector is substantially circular.

21. A frequency selective reflector according to claim 19, wherein the outer portion reflective surface includes elements which cancel the electromagnetic waves of the second frequency to prevent reflection of the electromagnetic waves of the second frequency from the outer portion.

22. A frequency selective reflector according to claim 19, wherein said outer portion substantially surrounds said inner portion.

23. A frequency selective reflector according to claim 22, wherein said reflector is substantially circular.

24. A frequency selective reflector according to claim 19, wherein said first frequency is less than said second frequency.

25. A frequency selective reflector according to claim 24, wherein said first frequency is 20 GHz and said second frequency is 30 GHz.

26. A frequency selective reflector according to claim 19, wherein the outer portion is comprised of a material having a reflective surface which reflects electromagnetic waves having a first frequency in a direction to a align with electromagnetic waves of the first frequency reflected from the inner portion and which diverts electromagnetic waves of the second frequency in a direction different from the direction of the reflection of electromagnetic waves of the second frequency reflected from the inner portion.

27. A frequency selective reflector according to claim 26, wherein the outer portion is comprised of a diffraction grating.

28. A frequency selective reflector for an electromagnetic antenna comprising:

an inner portion having a reflective surface to reflect electromagnetic waves having first and second frequencies; and an outer portion having a reflective surface which will reflect electromagnetic waves having the first frequency in the same direction as the reflection direction of electromagnetic waves having the first frequency reflected from the inner portion, and which prevents reflection of electromagnetic waves having the second frequency in the same direction as the direction of reflection of electromagnetic waves having the second frequency reflected from the inner surface, wherein the diameters of the inner and outer portions are selected so that the reflectors electrical size in terms of wavelengths will be substantially equalized for the first and second frequencies so that the beam widths of radiation patterns for the first and second frequencies will be substantially equalized, wherein the outer portion reflective surface includes elements which cancel the electromagnetic waves of the second frequency to prevent reflection of the electromagnetic waves of the second frequency from the outer portion, wherein said elements comprise corrugation recesses having dimensions to reflect electromagnetic waves having the second frequency substantially 180° out of phase with respect to reflections of the electromagnetic waves having the second frequency from adjacent surfaces of the outer portion to thereby cancel the reflection of electromagnetic waves having the second frequency from the outer portion.

29. A frequency selective reflector according to claim 28, wherein said corrugation recesses are at least partially filled with a dielectric material.

30. A frequency selective reflector for an electromagnetic antenna comprising:

an inner portion having a reflective surface to reflect electromagnetic waves having first and second frequencies; and an outer portion having a reflective surface which will reflect electromagnetic waves having the first frequency in the same direction as the reflection direction of electromagnetic waves having the first frequency reflected from the inner portion, and which prevents reflection of electromagnetic waves having the second frequency in the same direction as the direction of reflection of electromagnetic waves having the second frequency reflected from the inner surface, wherein the diameters of the inner and outer portions are selected so that the reflectors electrical size in terms of wavelengths will be substantially equalized for the first and second frequencies so that the beam widths of radiation patterns for the first and second frequencies will be substantially equalized, wherein the outer portion reflective surface includes elements which cancel the electromagnetic waves of the second frequency to prevent reflection of the electromagnetic waves of the second frequency from the outer portion, wherein said elements comprise stripes formed of a material which will reflect electromagnetic waves having the second frequency substantially 180° out of phase with the reflection of electromagnetic waves having the second frequency from adjacent surfaces of the outer portion to thereby cancel the reflection of electromagnetic waves having the second frequency from the outer portion.

31. A frequency selective reflector according to claim 30, wherein said stripes are comprised of a dielectric material.

32. A substantially circular frequency selective reflector for receiving and reflecting electromagnetic waves having different frequencies to provide substantially equal beam widths for radiation patterns of the electromagnetic waves, comprising:

an inner circular portion having a reflective surface which will reflect electromagnetic waves having a first frequency and a second frequency, wherein the first frequency is lower than the second frequency; and an outer circular portion substantially surrounding the inner circular portion, wherein the outer circular portion includes a corrugated surface to provide first and second reflective portions operating in conjunction with one another to reflect electromagnetic waves having the first frequency and to cancel electromagnetic waves having the second frequency, wherein the diameters of the inner and outer circular portions are selected so that the reflector's electrical size in terms of wavelengths will be substantially equalized for the first and second frequencies so that the beam widths of radiation patterns for the first and second frequencies will be substantially equalized.

33. A substantially circular frequency selective reflector for receiving and reflecting electromagnetic waves having different frequencies to provide substantially equal beam widths for radiation patterns of the electromagnetic waves, comprising:

an inner circular portion having a reflective surface which will reflect electromagnetic waves having a first frequency and a second frequency, wherein the first frequency is lower than the second frequency; and an outer circular portion substantially surrounding the inner circular portion, wherein the outer circular portion includes a diffraction grating which will diffract electromagnetic waves having the first frequency in a direction to align with electromagnetic waves of the first frequency reflected from the inner portion, and which will divert electromagnetic waves of the second frequency in a direction different than the direction of electromagnetic waves of the second frequency reflected from the inner circular portion, wherein the diameters of the inner and outer circular portions are selected so that the reflector's electrical size in terms of wavelengths will be substantially equalized for the first and second frequencies so that the beam widths of radiation patterns for the first and second frequencies will be substantially equalized.

* * * * *